US007192132B2

(12) United States Patent
Suzuki

(10) Patent No.: US 7,192,132 B2
(45) Date of Patent: Mar. 20, 2007

(54) INK JET HEAD UNIT AND PRINTER INCORPORATING THE SAME

(75) Inventor: Tomoji Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 249 days.

(21) Appl. No.: 10/928,736

(22) Filed: Aug. 30, 2004

(65) Prior Publication Data

US 2005/0078157 A1 Apr. 14, 2005

(30) Foreign Application Priority Data

Sep. 1, 2003 (JP) ..... P2003-308682

(51) Int. Cl.
*B41J 2/17* (2006.01)

(52) U.S. Cl. ..... 347/94

(58) Field of Classification Search ..... 347/68, 347/70, 85, 86, 87, 92, 93, 94
See application file for complete search history.

(56) References Cited

U.S. PATENT DOCUMENTS

| | | | | |
|---|---|---|---|---|
| 5,963,239 | A | 10/1999 | Nishioka et al. | |
| 6,000,789 | A | 12/1999 | Takagi et al. | |
| 6,000,790 | A | 12/1999 | Takagi et al. | |
| 6,007,191 | A | 12/1999 | Fujii et al. | |
| 6,099,111 | A * | 8/2000 | Chang | 347/71 |
| 6,152,557 | A | 11/2000 | Hagiwara et al. | |
| 6,196,671 | B1 | 3/2001 | Breemes, Sr. et al. | |
| 6,209,997 | B1 * | 4/2001 | Duong et al. | 347/94 |
| 6,863,390 | B2 * | 3/2005 | Arai et al. | 347/94 |
| 2003/0038868 | A1 | 2/2003 | Arai et al. | |

FOREIGN PATENT DOCUMENTS

| | | |
|---|---|---|
| EP | 1 285 761 | 2/2003 |
| JP | 03-224744 | 10/1991 |
| JP | 7-52405 | 2/1995 |
| JP | 07-125246 | 5/1995 |
| JP | 08-118672 | 5/1996 |
| JP | 9-286115 | 11/1997 |
| JP | 9-300654 | 11/1997 |
| JP | 2003-136720 | 5/2003 |

* cited by examiner

*Primary Examiner*—Anh T. N. Vo
(74) *Attorney, Agent, or Firm*—Nixon & Vanderhye P.C.

(57) ABSTRACT

A head chip has a first face formed with nozzle orifices from which ink is ejected, and a second face formed with at least one ink inlet communicated with the nozzle orifices. An ink passage communicates the nozzle orifices with the ink supply source to supply ink to be ejected. A filter is disposed in the ink passage at an upstream side of the ink inlet. The filter has a first face directed to an upstream side of the ink passage. A cover member covers at least a part of the first face of the filter, the cover member being adapted to allow ink in the ink passage to pass through while preventing air bubbles contained in the ink from coming in contact with the first face of the filter.

11 Claims, 10 Drawing Sheets

INK JET HEAD UNIT AND PRINTER INCORPORATING THE SAME

BACKGROUND OF THE INVENTION

The present invention relates to an ink jet head unit and a printer incorporating the same.

Japanese Patent Publication No. 3-224744A discloses an ink jet head unit (hereinafter, simply referred to as a head unit) provided with a damping chamber for absorbing ink pressure which is generated due to acceleration or the like while a carriage moves to carry the head unit.

The head unit is further provided with a filter disposed in an ink passage for preventing invaded foreign matter from flowing to the downstream side of the passage.

In such a head unit, air bubbles are accumulated in the damping chamber as a result of various causes. Such air bubbles tend to stay in a stagnant point in the ink passage, at which flow rate of the ink is zero or close to zero (e.g., in the vicinity of the filter where the area of the ink passage needs to be wider). In such a position, the air bubbles tend to grow larger.

In a case where the air bubbles which have grown under the high-temperature environment, for example, adhere onto the upstream side surface of the filter, the ink passage in the filter is clogged leading to a printing failure.

Further, an air bubble remaining in the damping chamber may be broken up into smaller bubbles due to vibrations or the like during the operation of the carriage. Such smaller bubbles may flow back into the ink passage of the upstream side of the head unit. In such a case, there is a possibility that the air bubbles may grow under the high temperature environment and enter the damping chamber again. As a result, the air bubbles may adhere onto the filter leading to the same problem as described above.

Japanese Patent Publication No. 9-300654A discloses a priming operation for discharging air bubbles with ink by forcibly sucking or compressing ink in the ink passage, thereby removing air bubbles in the ink passage. In order to enhance the reliability of the priming operation, the air bubbles to be discharged are passed through narrowed passages and broken up to smaller bubbles, thereby reducing discharging resistance. FIGS. 12 to 15 show such a structure.

As shown in FIG. 12, an ink supply case 200 is formed with an ink supply pipe 201 and an opening portion (ink supply port) 205 which connects the ink supply pipe 201 and an ink inlet 203 of a head chip 202. A nozzle section 204 in which a plurality of nozzle orifices are arrayed with a fixed pitch is provided on an end of the head chip 202 which is opposite to the end face 208 (FIG. 15) formed with the ink inlet 203.

As shown in FIGS. 13 and 15, a plurality of thin walls 211 are arrayed at the upstream side of the ink supply port 205. Each of the thin walls 211 extends perpendicularly to the extending direction of the ink supply port 205 (the ink inlet 203). The downstream side end of each thin wall 211 is placed so as to maintain a prescribed distance d from the end face of the head chip 202 having the ink inlet 203. Accordingly, a plurality of narrowed passages 212 each having a width e is formed at the upstream side of the boundary (end face 208) between the ink inlet 203 and the ink supply port 205.

As indicated by dashed lines in FIG. 14, the ink inlet 203 is an elongated rectangle having a width K and a height H2 which is considerably smaller than a height H1 of the ink supply port 205. Therefore, air bubbles tend to stay at the boundary 208.

In a case where air bubbles exist in the ink supply pipe 201, the air bubbles are moved toward the head chip 202 by the priming operation and broken up by the narrowed passages 212.

This publication, however, is silent about countermeasures for solving the above described problems (i.e., the case where the broken bubbles adhere onto the filter or flow back to the upstream side of the ink passage).

In addition, high machining accuracy and assembling accuracy are required for forming the narrowed passages 212 in the vicinity of the ink supply port 205 of the ink supply case 200 and for assembling the head chip 202 while maintaining the above-described distance d, resulting in a higher cost.

SUMMARY OF THE INVENTION

It is therefore an object of the invention to provide an ink jet head unit capable of effectively eliminating the undesired influence due to air bubbles remaining in the damping chamber.

It is also an object of the invention to provide a printer incorporating such an ink jet head unit.

In order to achieve the above objects, according to the invention, there is provided an ink jet head unit connected to an ink supply source, comprising:

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet, the filter having a first face directed to an upstream side of the ink passage; and a cover member, which covers at least a part of the first face of the filter, the cover member being constructed to allow ink in the ink passage to pass through while preventing air bubbles contained in the ink from coming in contact with the first face of the filter.

With this configuration, it is possible to prevent an air bubble remaining in the ink passage from adhering to the first face of the filter. Accordingly, it is possible to prevent the filter from being clogged, thereby eliminating printing failure.

Preferably, a damping chamber forming member is fixed to the second face of the head chip, the damping chamber forming member having at least one damping chamber for dampening pressure fluctuation occurred therein. The filter and the cover member are disposed between the ink inlet and the damping chamber.

Here, it is preferable that the cover member is formed with at least one opening communicating the damping chamber and the first face of the filter.

It is further preferable that the opening has a size which prevents an air bubble having a diameter of 1.5 mm from entering thereinto.

The at least one opening may at least one elongated slit.

Preferably, an ink supply pipe supplies ink from the ink supply source to the damping chamber. An end portion of the ink supply pipe is disposed within the damping chamber. A seal member surrounds the end portion of the ink supply pipe, thereby defining a space for storing ink therein. The end portion of the ink supply pipe is sealable with ink filling the space.

With this configuration, it is possible to prevent an air bubble from flowing back to the ink supply pipe, thereby preventing the flowed-back and enlarged air bubble from entering the damping chamber again.

Here, it is preferable that the cover member and the seal member are monolithically formed.

Alternatively, the seal member is monolithically formed with the damping chamber forming member.

Preferably, the seal member comprises an annular wall radially spaced from and surrounding the end portion of the ink supply pipe.

According to the invention, there is also provided an ink jet printer, comprising:

an ink supply source, which stores ink therein;

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet, the filter having a first face directed to an upstream side of the ink passage; and a cover member, which covers at least a part of the first face of the filter, the cover member being constructed to allow ink in the ink passage to pass through while preventing air bubbles contained in the ink from coming in contact with the first face of the filter.

According to another arrangement of the invention, there is provided an ink jet head unit connected to an ink supply source, comprising:

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet;

an ink supply pipe which supplies ink from the ink supply source to the damping chamber, an end portion of the ink supply pipe being disposed within the damping chamber; and a seal member surrounding the end portion of the ink supply pipe, defining a space for storing ink therein, wherein the end portion of the ink supply pipe is sealable with ink filling the space.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Figure 1:
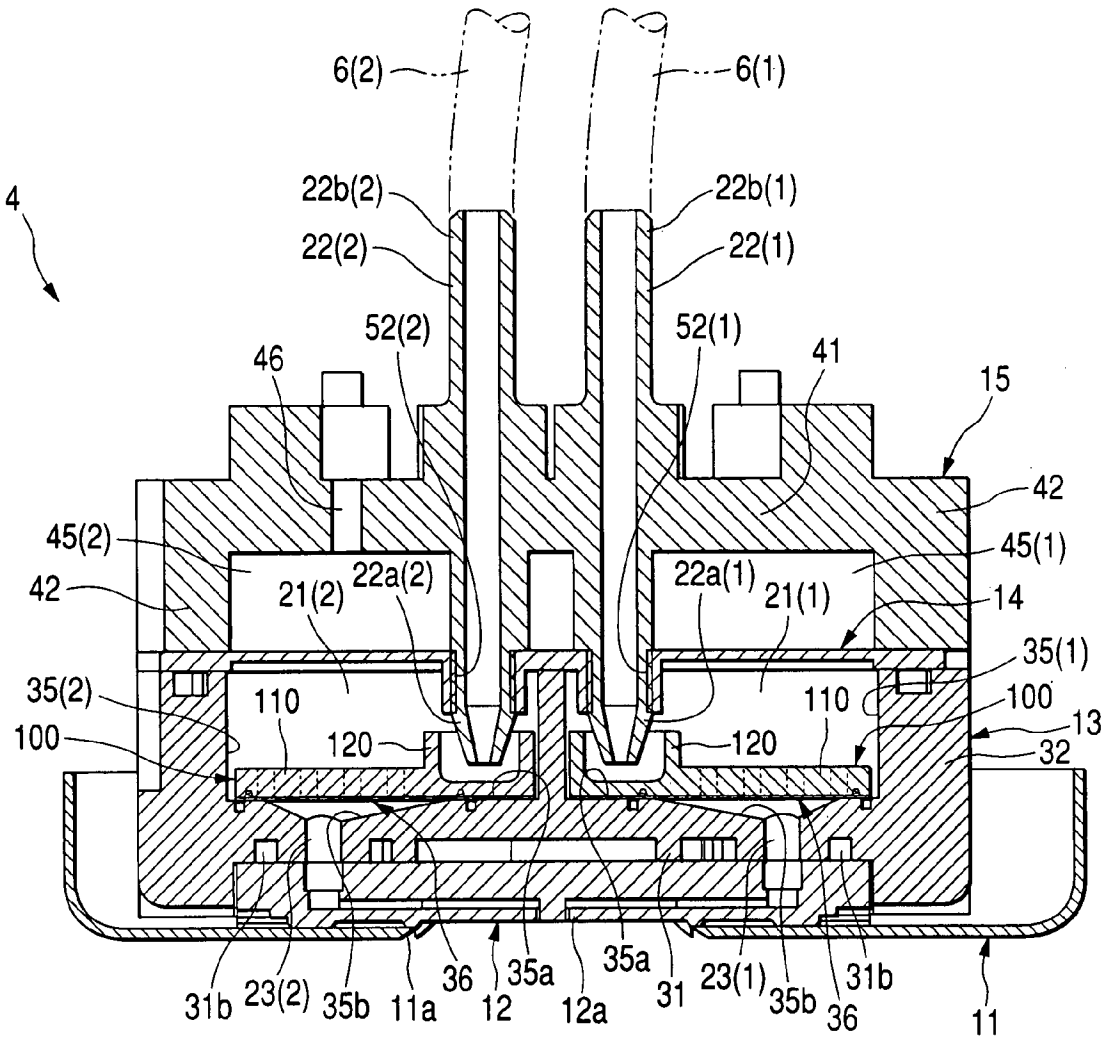
FIG. 1 is a section view of an ink jet head unit according to a first embodiment of the invention.

Referring now to the drawings, a description will be given of one preferred embodiment of a head unit for an ink jet printer.

Figure 2:
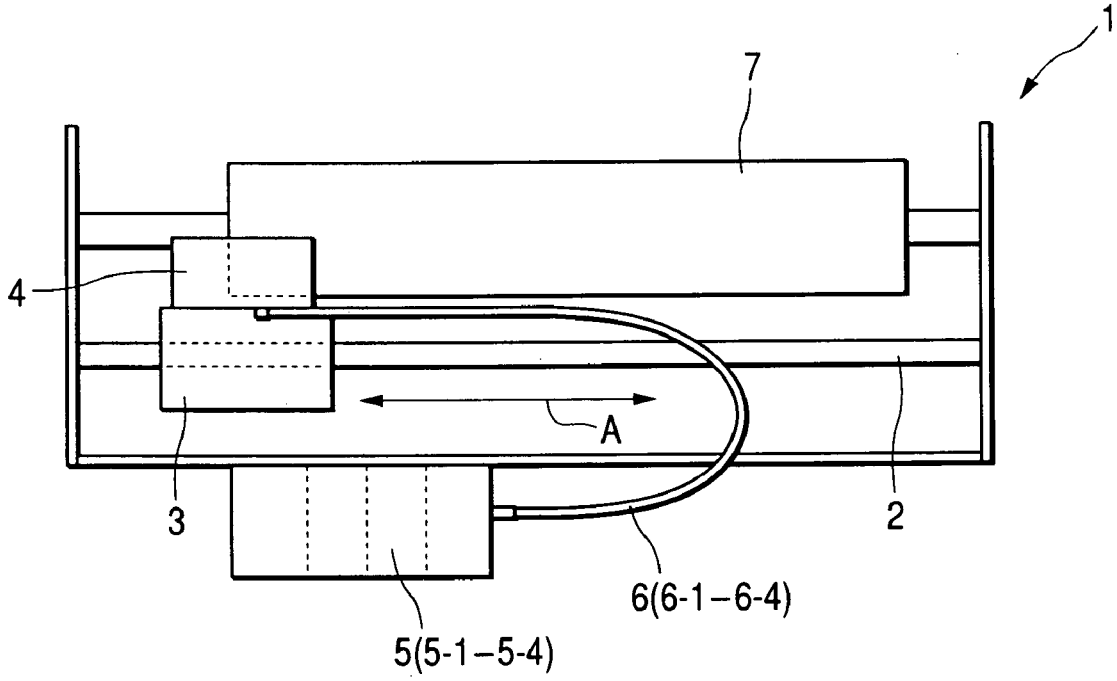
FIG. 2 is a schematic view of an ink jet printer incorporating the head unit of FIG. 1.

As shown in FIGS. 1 and 2, an ink jet printer 1 in this embodiment is of a serial type, and an ink jet head unit 4 (hereinafter, simply referred as a head unit) is mounted on a carriage 3 capable of reciprocating along a guide shaft 2. Ink is supplied to this head unit 4 through a flexible ink tube 6 from an ink tank 5 disposed in a predetermined position. In this embodiment, ink of four colors including cyan, magenta, yellow, and black is supplied from ink tanks 5-1 to 5-4, in which the ink is respectively stored, to the head unit 4 through four ink tubes 6-1 to 6-4.

The head unit 4 will be explained in detail with reference to FIGS. 1 to 4. The head unit 4 of this embodiment has a unit cover 11 whose rear face side is open and which has the shape of a rectangular parallelepiped, and a head-unit assembly is accommodated in this unit cover 11.

A head chip 12, a unit base 13, a damper film 14 made of rubber, a damper holder 15, and a relay board 16 are superposed one on top of another in the unit cover 11 in that order from its front face side. Four damping chambers 21(1) to 21(4) are defined by the unit base 13 and the damper film 14. The unit cover 11, the unit base 13, and the damper holder 15 are formed of, for example, resin moldings.

Front end portions 22*a*(1) to 22*a*(4) of ink supply pipes 22(1) to 22(4), which are formed integrally with the damper holder 15, communicate with the respective damping chambers 21(1) to 21(4), while the respective ink tubes 6(1) to 6(4) are connected to rear end portions 22*b*(1) to 22*b*(4) of the ink supply pipes 22(1) to 22(4). The respective damping chambers 21(1) to 21(4) are formed in the head chip 12 so as to communicate with four ink inlets 24(1) to 24(4) via ink supply ports 23(1) to 23(4).

Accordingly, the ink from the ink tanks 5(1) to 5(4) is supplied to the respective damping chambers 21(1) to 21(4) via the ink tubes 6(1) to 6(4) and the ink supply pipes 22(1) to 22(4), and is further supplied from the damping chambers 21(1) to 21(4) to nozzle orifice groups of the respective colors via the ink supply ports 23(1) to 23(4) and the ink inlets 24(1) to 24(4).

The head chip 12 has the shape of a flat rectangular parallelepiped, and its front face 12*a* is the nozzle formation face, where nozzle orifice rows (not shown) for discharging ink of the respective colors are formed. This nozzle formation face 12*a* is exposed from a front face opening 11*a* of the unit cover 11. In addition, flexible wiring boards 25(1) and 25(2) for feeding electric power are adjacent side faces of the head chip 12 and are led out to the rear side along inner sides of the side faces of the unit cover 11, and are connected to the rear face of the relay board 16. Head-chip driving ICs 26(1) and 26(2) are attached to those portions of the flexible wiring boards 25(1) and 25(2) which are opposed to the respective side faces of the unit cover 11.

The unit base 13 disposed on the rear side of the head chip 12 includes a front wail 31 to which the head chip 12 is bonded and fixed, side walls 32 extending orthogonally from the four edges of the front wall 31 in the rearward direction, and a vertical partition wall 33 and a horizontal partition wall 34 which partition the space defined by the rear face of the front wall 31 and the side walls 32 into a crisscross form.

Figure 3:
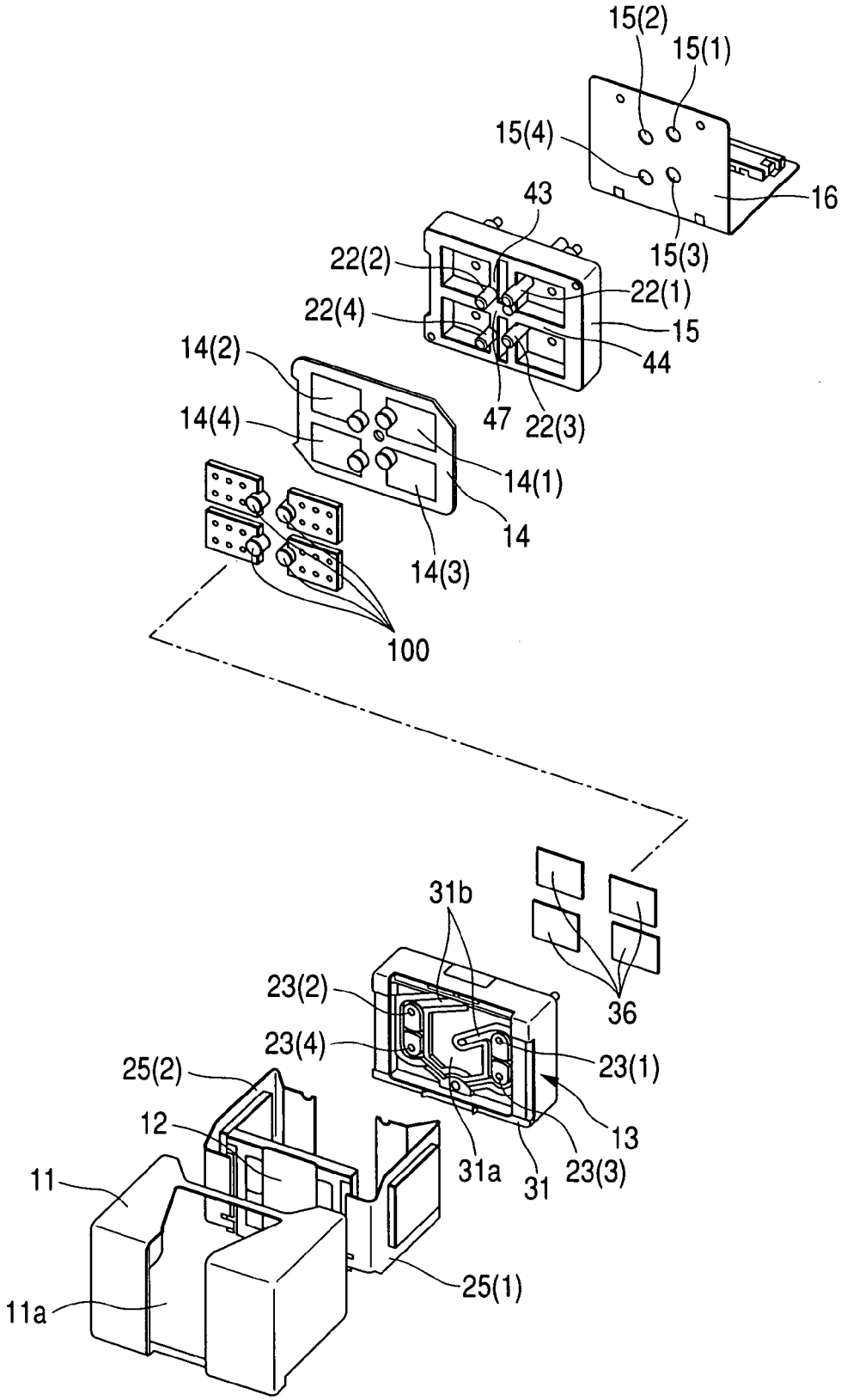
FIG. 3 is a perspective view of the disassembled state of the head unit viewed from the front side thereof.
Figure 4:
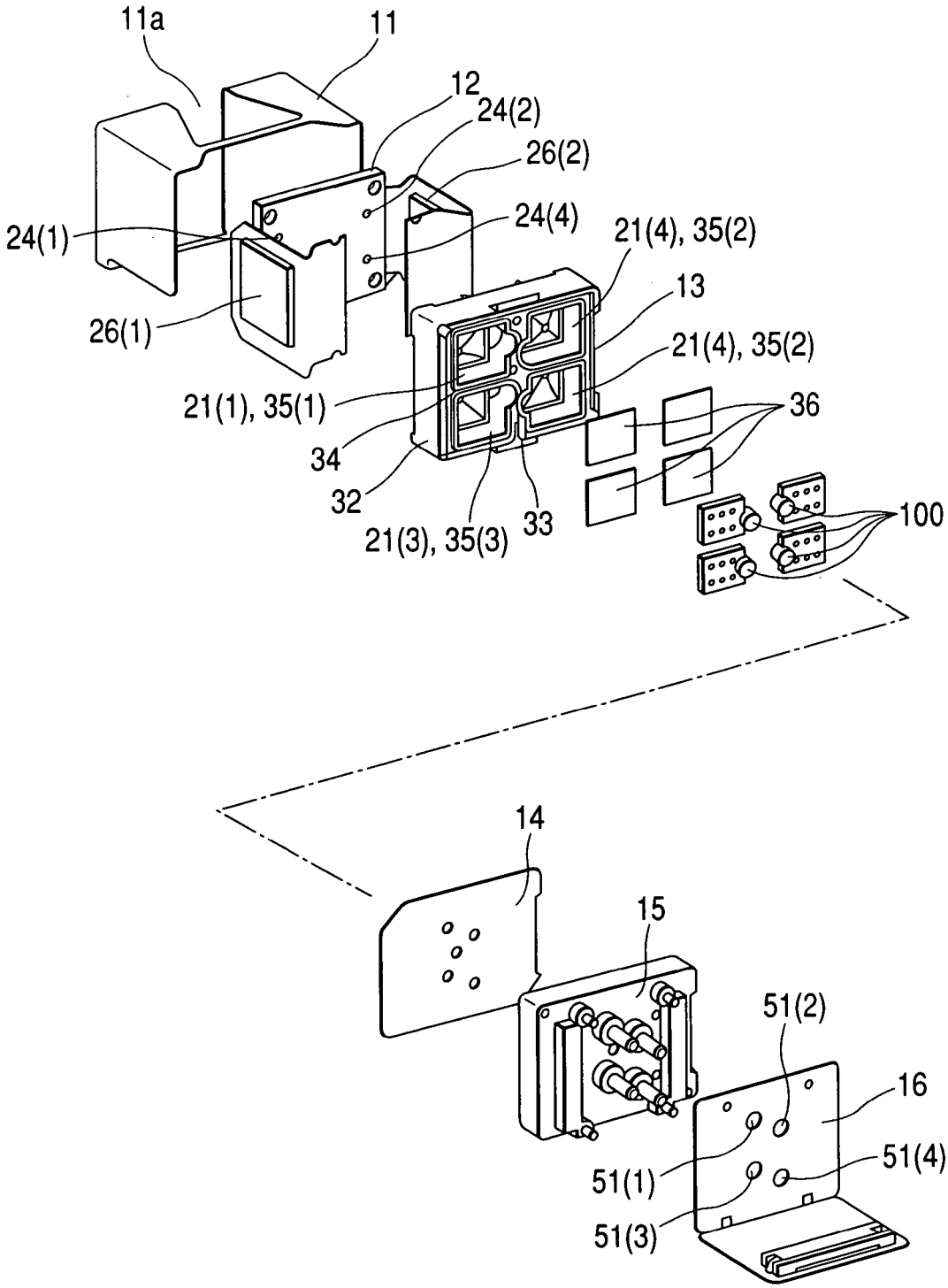
FIG. 4 is a perspective view of the disassembled state of the head unit viewed from the rear side thereof.

As shown in FIG. 3, a recessed portion 31*a* to which the head chip 12 is to be fitted is formed in the front face of the front wall 31, bonding grooves 31*b* for filling an adhesive are formed in bottom face of the recessed portion 31*a*, and upper end portions of these bonding grooves 31*b* extend to the upper faces of the side walls 32. The head chip 12 is fitted to the recessed portion 31*a* and is bonded to the front wall 31 by the adhesive filled in the bonding grooves 31*b*.

Four recessed portions 35(1) to 35(4) to be damping chambers are formed in a rear portion of the unit base 13 by the vertical partition wall 33 and the horizontal partition wall 34. These recessed portions are substantially of identical shape, and the ink supply ports 23(1) to 23(4) formed in the front wall 31 are open to bottom faces 35*a* of the respective recessed portions 35(1) to 35(4).

In addition, filters 36 are thermally deposited in such a manner as to cover the bottom faces 35*a*, so that ink is supplied from the damping chambers 21(1) to 21(4) to the head chip 12 while passing through the filters 36. In a bottom face 35*a* of each of the recessed portions 35(1) to 35(4), a dent 35*b* is formed so as to define a minute passage between the bottom face 35*a* and the filter 36.

An unfixed filter cover 100 is disposed in each of the damping chambers 21(1) to 21(4). The filter cover 100 comprises a plate-shaped portion 110 which covers at least a part of the upstream side face of the filter 36, and a cup-shaped portion 120 adapted to surround a front end portion of an associated one of the ink supply pipes 22(1) to 22(4) inserted into the damping chambers 21(1) to 21(4). The filter cover 100 is molded with resin so that the plate-shaped portion 110 and the cup-shaped portion 120 are monolithically formed.

Figure 5:
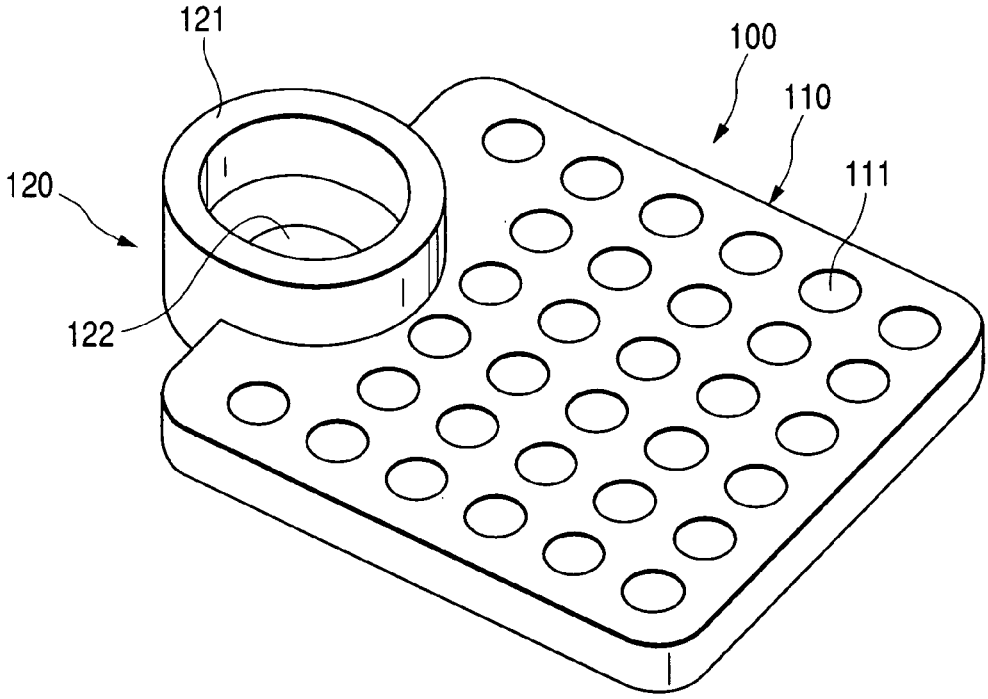
FIG. 5 is a perspective view of a filter cover incorporated in the head unit of FIG. 1.
Figure 6:
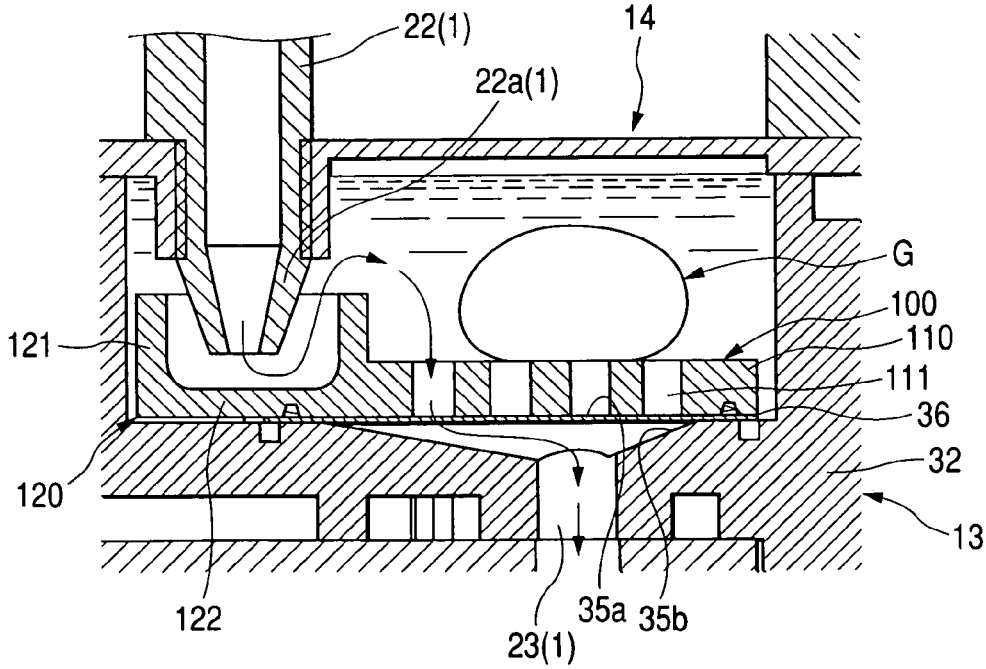
FIG. 6 is an enlarged section view showing an essential portion of the head unit of FIG. 1.

As shown in FIGS. 5 and 6, the plate-shaped portion 110 is formed with a plurality of circular holes 111 respectively communicating between the upstream side face of each of the filters 36 and the damping chambers 21(1) to 21(4). These holes 111 are formed to a size, which can prevent a large air bubble G, which is generated in the damping chamber 21(1) to 21(4), from coming into direct contact with the upstream side face of the filter 36. In this embodiment, the holes 111 are formed 0.5 mm in diameter. However, the diameter may fall within a range from 0.1 mm to 1.0 mm because a smaller air bubble G has a diameter approximately 1.5 mm. The minimum value of the range depends on the machining technique.

The cup-shaped portion 120 is constituted by a bottom wall 122 and an annular wall 121 upright from the bottom wall 122 so as to have an inner diameter slightly larger than an outer diameter of each of the front end portions 22*a*(1) to 22*a*(4) of the ink supply pipes 22(1) to 22(4). Accordingly, a gap to be a part of the ink passage having a width of 0.2 to 1.0 mm is defined therebetween. The height of the annular wall 121 is determined such that each of the front end portions 22*a*(1) to 22*a*(4) of the ink supply pipes 22(1) to 22(4) stays within the cup-shaped space even when the bottom face of the filter cover 110 comes in contact with the upstream side face of the filter 36.

Next, the damper film 14 is fixed by being bonded to the rear face of the unit base 13, i.e., rear end faces of the side walls 32, the vertical partition wall 33, and the horizontal partition wall 34. Further, the damper film 14 is pressed against the unit base 13 by the damper holder 15 attached to the rear face side of the damper film 14.

As for the damper film 14, its portions 14(1) to 14(4) opposing the respective recessed portions 35(1) to 35(4) are thin-walled and are deflectable in outward directions of their faces. The recessed portions 35(1) to 35(4) are sealed by the thin-walled portions 14(1) to 14(4) of the damper film 14 to form the damping chambers 21(1) to 21(4).

The damper holder 15 has a rear wall 41, side walls 42 extending orthogonally from its outer edges in the forward direction, and a vertical partition wall and a horizontal partition wall (neither are shown) which partition the space surrounded by a front face of the rear wall 41 and the side walls 42 into a crisscross form. Four recessed portions 45(1) to 45(4) opposing the damping chambers 21(1) to 21(4) are thereby formed. The recessed portions 45(1) to 45(4) communicate with the atmosphere through ventilation holes 46 formed in the rear wall 41. The thin-walled portions 14(1) to 14(4) of the damper film 14 are freely deflectable in outward directions of their faces by the recessed portions 45(1) to 45(4).

In the damper holder 15 in this embodiment, the four ink supply pipes 22(1) to 22(4) are formed integrally with its portion 47 where the vertical and horizontal partition plates cross, and the damper holder 15 is formed of, for example, a resin molding. The rear-end portions 22*b*(1) to 22*b*(4) of the ink supply pipes 22(1) to 22(4) project to the rear side by passing through holes 51(1) to 51(4) formed in the relay board 16, and are connected to the ink tubes 6(1) to 6(4). In contrast, the tip portions 22*a*(1) to 22*a*(4) of the ink supply pipes 22(1) to 22(4) are passed through insertion holes 52(1) to 52(4) formed in the damper film 14, and project into the respective damping chambers 21(1) to 21(4). The insertion holes 52(1) to 52(4) project into the respective damping chambers 21(1) to 21(4) and have predetermined lengths, and their inside diameters are formed to be slightly smaller than the outside diameters of the front end portions 22*a*(1) to 22*a*(4) of the ink supply pipes 22(1) to 22(4).

Accordingly, the portions of the damper film 14 where the insertion holes 52(1) are formed are in close contact with outer peripheral faces of the front end portions 22*a*(1) to 22*a*(4) by the resilient restoring force of the damper film 14 itself, so that the faces of contact between the damper film 14 and the front end portions 22*a*(1) to 22*a*(4) are in a completely sealed state.

The outer diameter of each of the front end portions 22*a*(1) to 22*a*(4) of the ink supply pipes 22(1) to 22(4) are narrowed so that the large gap is secured between the front end portion and the annular wall 121, thereby reducing ink flow resistance.

The thus constructed head unit 4 performs ink ejection while moving in the directions indicated by arrows A in FIGS. 1 and 2. The fluctuation of pressure applied to the ink inside the ink tube 6 is absorbed or alleviated by the four damping chambers 21(1) to 21(4) provided in the head unit 4.

Since ink is supplied from the damping chambers 21(1) to 21(4) to the head chip 12 through the filter 36, it is possible to reliably capture foreign matter flown from the upstream side with the filter 36, preventing clogging in the nozzles.

As shown in FIG. 6, for some reason, air bubble G sometimes remains in the damping chamber 21(1) to 21(4) and is enlarged. However, since the plate-shaped portion 110 of the filter cover 100 covers the upstream side face of the filter 36, it is possible to prevent the remaining air bubble G from adhering to the upstream side face of the filter 36.

Accordingly, it is possible to prevent the large remaining air bubble G from coming into close contact with the upstream side face of the filter 36 blocking the ink passage. Thus, printing failure due to a clogged ink passage in the filter 36 can be prevented.

Since the plate-shaped portion 110 is formed with many holes 111, it does not interfere with the ink flow. Furthermore, during the priming operation, the air bubble can be moved to the filter 36 side through the holes 111. Thus, the air bubble can be purged easily.

According to the cup-shaped portion 120 formed in the filter cover 100, the front end portions 22*a*(1) to 22*a*(4) of the respective ink supply tubes 22(1) to 22(4) can be sealed with liquid. Hence, it is possible to prevent the air bubble G from flowing back from the damping chamber 21(1) to 21(4) to the ink supply pipe 22(1) to 22(4). As a result, it is possible to prevent the air bubble, which has been flowed-back and enlarged, from entering into the head unit again.

Figure 7:
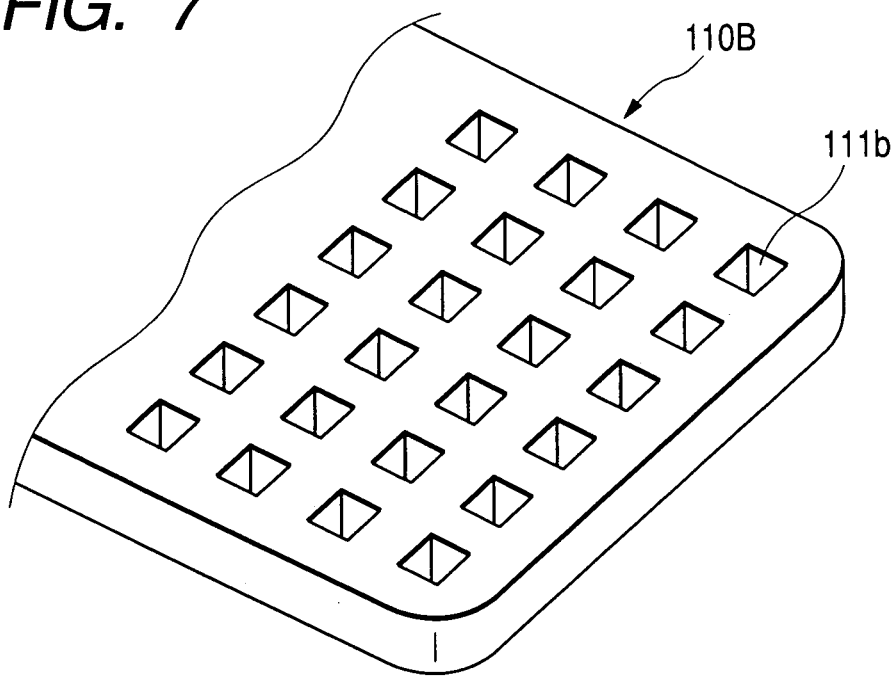
FIG. 7 is a partial perspective view of a filter cover according to a second embodiment of the invention.
Figure 8:
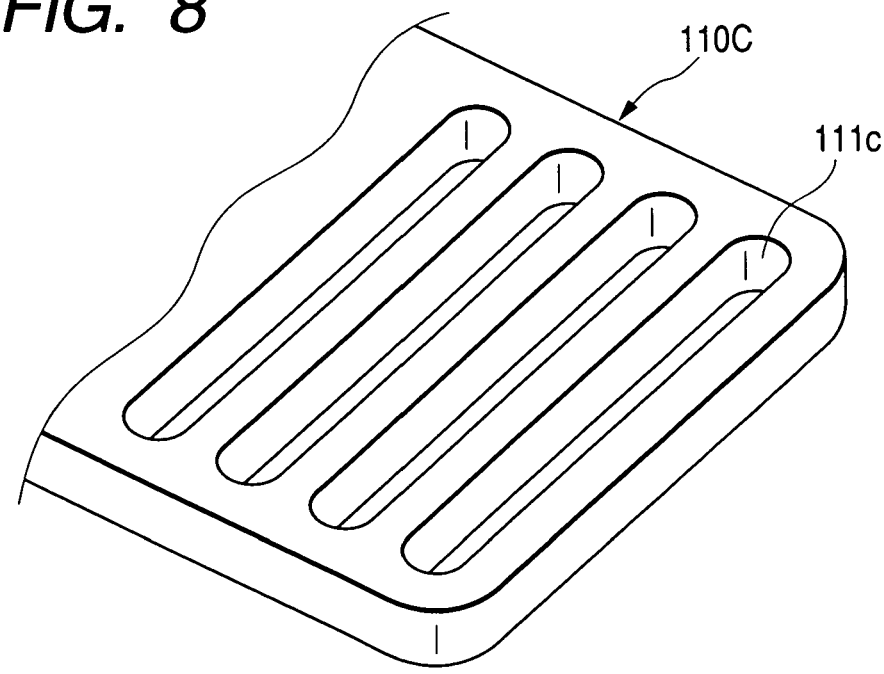
FIG. 8 is a partial perspective view of a filter cover according to a third embodiment of the invention.

The configuration, number and the shape of the holes 111 formed in the plate-shaped portion 110 of the filter cover 100 may be modified. For example, as a plate-shaped portion 110B shown in FIG. 7, rectangular holes 111*b* may be formed. Alternatively, as a plate-shaped portion 110C shown in FIG. 8, elongated slits 111*c* may be formed. Even in this case, it is necessary to set the length and width of the holes 111*b*, and 111*c* to a size such that a large air bubble does not come into contact with the filter 36 in order to attain the same effect as that of the holes 111 in FIG. 5. In FIG. 7, holes 111*b* may be formed into rectangular holes in which each of the sides has a length of 0.1 to 1.0 mm. In FIG. 8, each of the elongated slits 111*c* has a width of 0.1 to 1.0 mm. The minimum value of the size depends on the machining technique the same as the case of the above-described holes 111.

Figure 9:
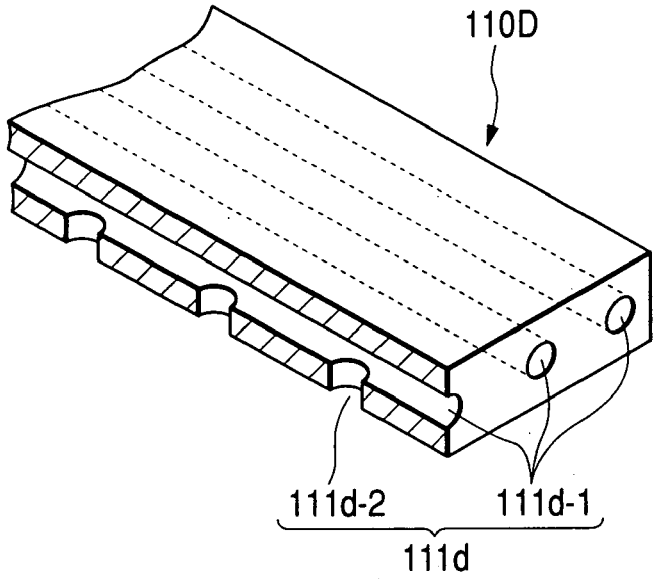
FIG. 9 is a partial perspective view of a filter cover according to a fourth embodiment of the invention.

The holes do not always have to penetrate the plate-shaped portion 110 in the thickness direction thereof. For example, in the plate-shaped portion 110D shown in FIG. 9, the ink is allowed to flow in from a side end face, and the ink flows out from the bottom face opposing the upstream side face of the filter 36 may be adopted.

Here, horizontal holes 111*d*-1 opened at the side end faces are laterally extended within the plate-shaped portion 110D, and a large number of vertical holes 111*d*-2 are formed in the bottom face of the plate-shaped portion 110D so as to communicate with the respective horizontal holes 111*d*-1. Accordingly, there are formed holes 111*d* constituting ink passages continued from the side faces to the bottom face of the plate-shaped portion 110D.

In this case, even when the upper face of the plate-shaped portion 110D is covered with an air bubble, since the air bubble does not reach the side end faces, blockage of the ink passage can be prevented. As such, holes where the large air bubble cannot pass through but only the ink can pass therethrough may be formed.

Figure 10:
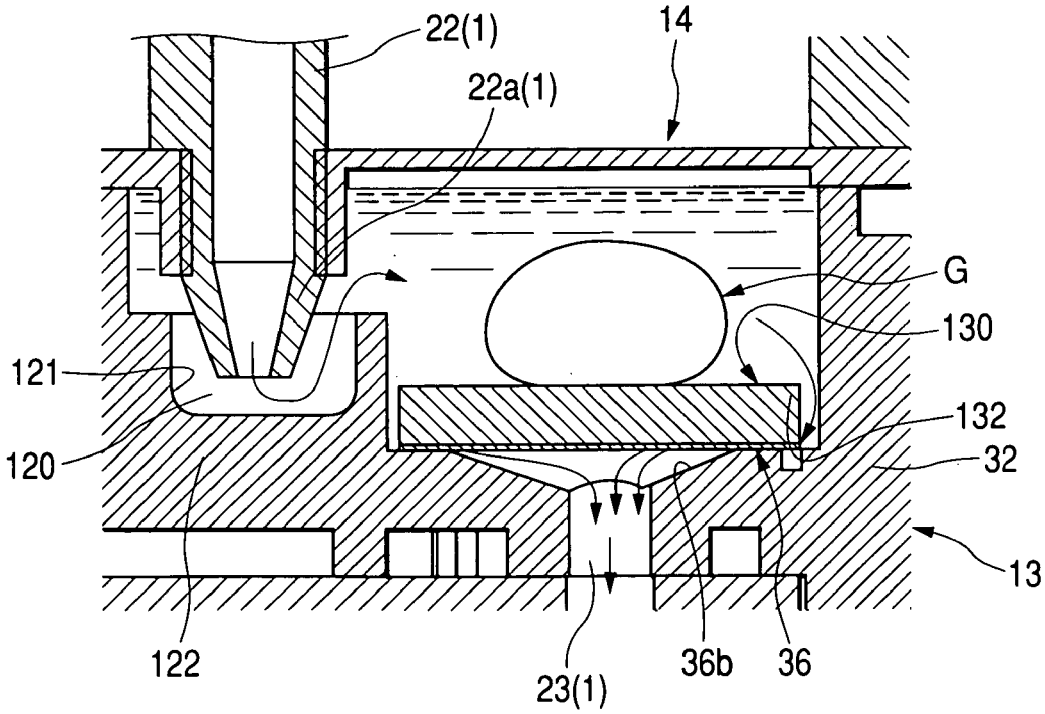
FIG. 10 is an enlarged section view showing an essential portion of a head unit according to a fifth embodiment of the invention.

Since the filter cover 100 disposed in each of the damping chambers 21(1) to 21(4) is not fixed, a slight gap may be formed between the upstream side face of the filter 36 and the bottom face of the filter cover 100. Accordingly, a plate-shaped portion 132 of a filter cover 130 as shown in FIG. 10, may be provided without holes.

In this case, ink flows through the space between the filter 36 and the plate-shaped portion 132, or an area equivalent to the thickness of the filter 36 of the end face of the filter 36. Accordingly, the ink flows to the ink supply port 23(1) to 23(4) through the filter 36.

Further, in this embodiment, the plate-shaped portion 110 and the cup-shaped portion 120 are not monolithically formed. That is, the cup-shaped portion 120 may be embodied by an annular wall 121 directly protruded from the front plate portion 31 of the unit base 13.

Figure 11:
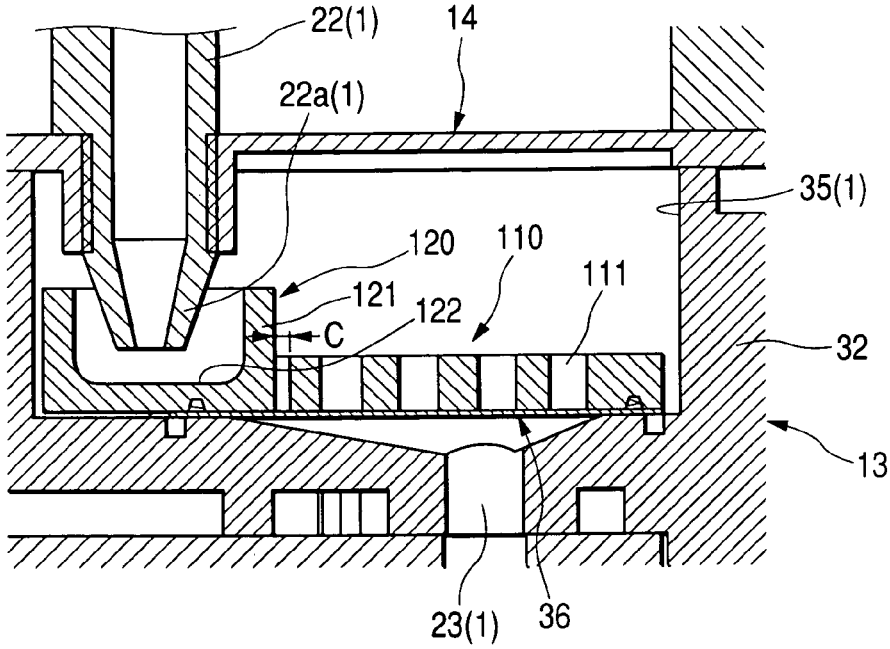
FIG. 11 is an enlarged section view showing an essential portion of a head unit according to a sixth embodiment of the invention.
Figure 12:
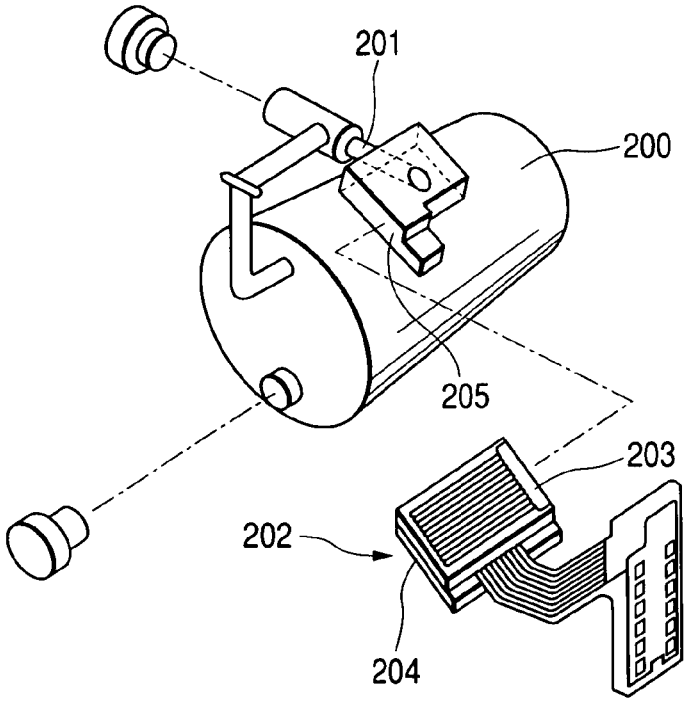
FIG. 12 is a perspective view of a disassembled state of a conventional ink jet head unit.
Figure 13:
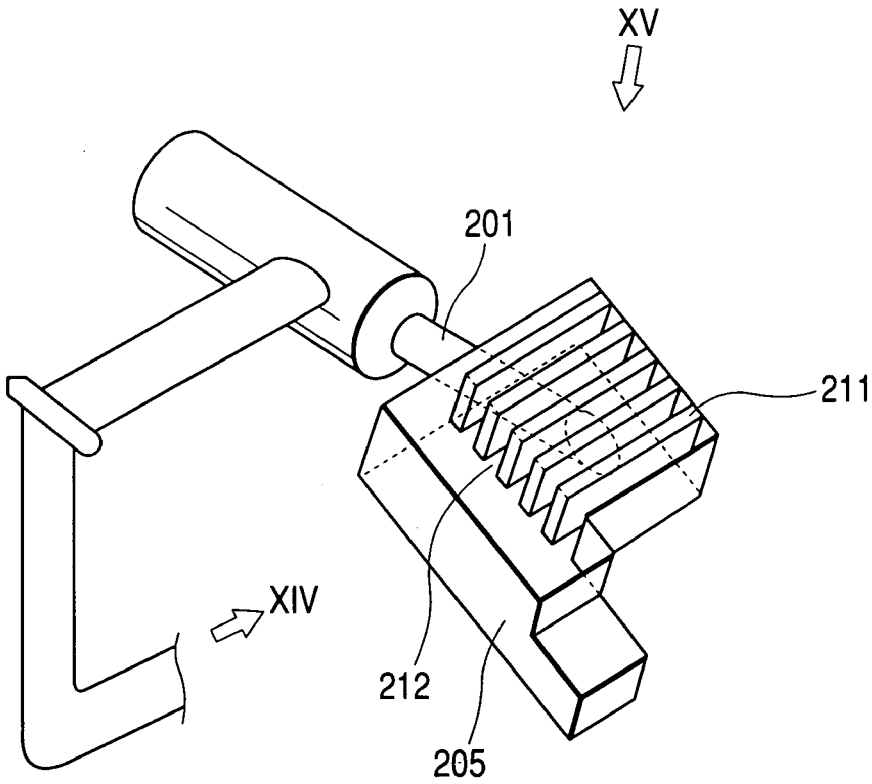
FIG. 13 is a perspective view of narrowed passages provided in the head unit of FIG. 12.
Figure 14:
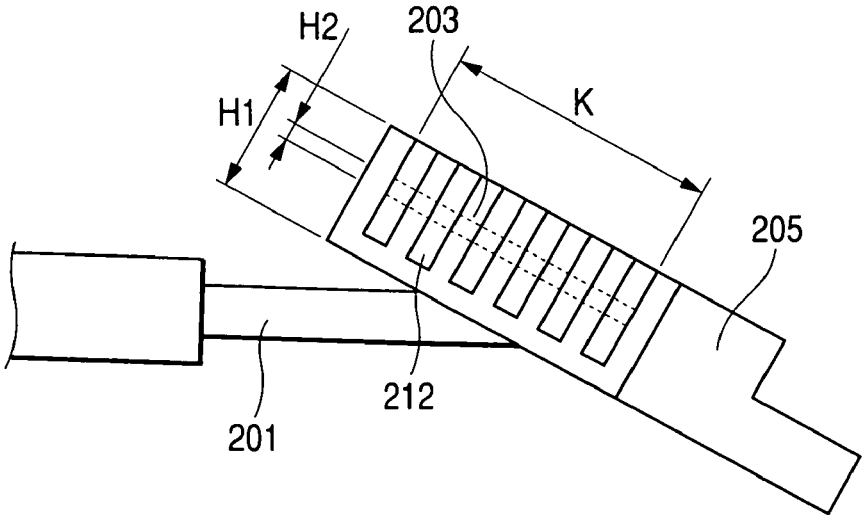
FIG. 14 is a diagram showing an ink passage in the head unit, viewed from the direction of an arrow XIV.
Figure 15:
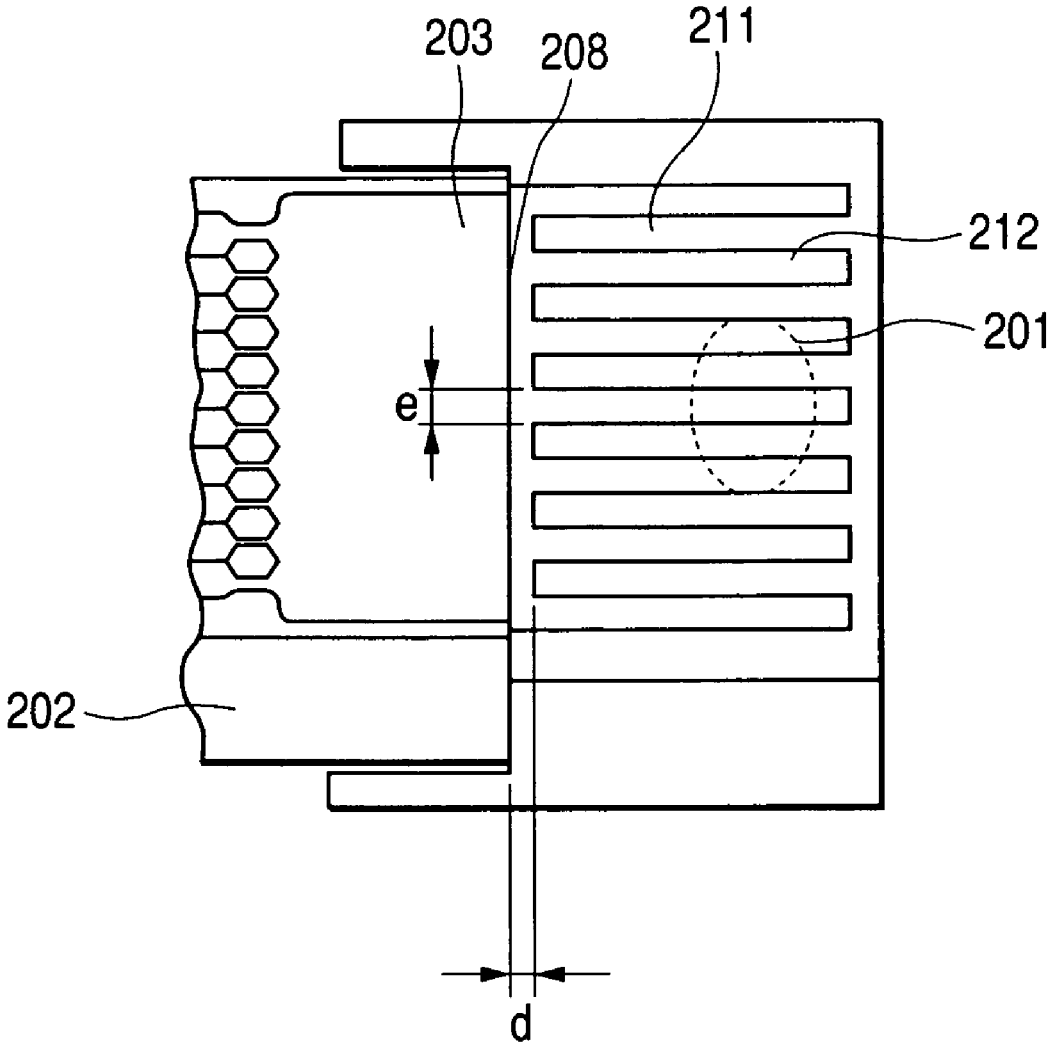
FIG. 15 is a diagram showing the ink passage, viewed from the direction of an arrow XV.

Alternatively, as shown in FIG. 11, the plate-shaped portion 110 and the cup-shaped portion 120 may be provided separately while defining a clearance having a width c. This width c is the same size as the diameter of the holes 111 formed in the plate-shaped portion 110, thereby preventing an air bubble from passing through to the filter 36 side.

Even when only one of the plate-shaped portion 110 and the cup-shaped portion 120 is formed, it serves to eliminate the problem of the remaining air bubble. For example, when only the plate-shaped portion 110 is formed, the problem of the remaining air bubble adhering to the filter 36 can be solved. When only the cup-shaped portion 120 is formed, the problem of the back-flow of the air bubble into the ink supply pipe 22(1) to 22(4) can be solved.

Although the above-described embodiment concerns the head unit mounted in a serial-type ink jet printer, the invention is similarly applicable to the head unit for another type of ink jet printer.

Although the above-described embodiment concerns the head unit mounted in the ink jet printer performing color printing in four colors, the invention is similarly applicable to the head unit for an ink jet printer performing single color printing or printing with a plurality of colors other than the four colors.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An ink jet head unit connected to an ink supply source, comprising:

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet, the filter having a first face directed to an upstream side of the ink passage;

a cover member, which covers at least a part of the first face of the filter, the cover member being constructed to allow ink in the ink passage to pass through while preventing air bubbles contained in the ink from coming in contact with the first face of the filter; and a damping chamber forming member, fixed to the second face of the head chip, the damping chamber forming member having at least one damping chamber for dampening pressure fluctuation occurred therein, wherein the filter and the cover member are disposed between the ink inlet and the damping chamber, and wherein the cover member is placed so as to come in contact with the first face of the filter.

2. An ink jet head unit connected to an ink supply source, comprising:

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet, the filter having a first face directed to an upstream side of the ink passage;

a cover member, which covers at least a part of the first face of the filter, the cover member being constructed to allow ink in the ink passage to pass through while preventing air bubbles contained in the ink from coming in contact with the first face of the filter; and a damping chamber forming member, fixed to the second face of the head chip, the damping chamber forming member having at least one damping chamber for dampening pressure fluctuation occurred therein, wherein the filter and the cover member are disposed between the ink inlet and the damping chamber, and wherein the cover member is formed with at least one opening communicating the damping chamber and the first face of the filter.

3. The ink jet head unit as set forth in claim 2, wherein the opening has a size which prevents an air bubble having a diameter of 1.5 mm from entering thereinto.

4. The ink jet head unit as set forth in claim 2, wherein the at least one opening comprises at least one elongated slit.

5. An ink jet head unit connected to an ink supply source, comprising:

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet, the filter having a first face directed to an upstream side of the ink passage;

a cover member, which covers at least a part of the first face of the filter, the cover member being constructed to allow ink in the ink passage to pass through while preventing air bubbles contained in the ink from coming in contact with the first face of the filter;

a damping chamber forming member, fixed to the second face of the head chip, the damping chamber forming member having at least one damping chamber for dampening pressure fluctuation occurred therein, wherein the filter and the cover member are disposed between the ink inlet and the damping chamber;

an ink supply pipe which supplies ink from the ink supply source to the damping chamber, an end portion of the ink supply pipe being disposed within the damping chamber; and a seal member surrounding the end portion of the ink supply pipe, defining a space for storing ink therein, wherein the end portion of the ink supply pipe is sealable with ink filling the space.

6. The ink jet head unit as set forth in claim 5, wherein the cover member and the seal member are monolithically formed.

7. The ink jet head unit as set forth in claim 5, wherein the seal member is monolithically formed with the damping chamber forming member.

8. The ink jet head unit as set forth in claim 5, wherein the seal member comprises an annular wall radially spaced from and surrounding the end portion of the ink supply pipe.

9. An ink jet printer, comprising:

an ink supply source, which stores ink therein;

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet, the filter having a first face directed to an upstream side of the ink passage;

a cover member, which covers at least a part of the first face of the filter, the cover member being constructed to allow ink in the ink passage to pass through while preventing air bubbles contained in the ink from coming in contact with the first face of the filter; and a damping chamber forming member, fixed to the second face of the head chip, the damping chamber forming member having at least one damping chamber for dampening pressure fluctuation occurred therein, wherein the filter and the cover member are disposed between the ink inlet and the damping chamber, and wherein the cover member is placed so as to come in contact with the first face of the filter.

10. An ink jet head unit connected to an ink supply source, comprising:

a head chip, having a first face formed with nozzle orifices from which ink is ejected, and a second face formed with at least one ink inlet communicated with the nozzle orifices;

an ink passage communicating the nozzle orifices with the ink supply source to supply ink to be ejected;

a filter, disposed in the ink passage at an upstream side of the ink inlet;

an ink supply pipe which supplies ink from the ink supply source to the damping chamber, an end portion of the ink supply pipe being disposed within the damping chamber; and a seal member surrounding the end portion of the ink supply pipe, defining a space for storing ink therein, wherein the end portion of the ink supply pipe is sealable with ink filling the space.

11. An ink jet head unit as set forth in claim 10, wherein the seal member comprises an annular wall radially spaced from and surrounding the end portion of the ink supply pipe.

* * * * *